US005395012A

United States Patent [19]

Grill et al.

[11] Patent Number: 5,395,012

[45] Date of Patent: Mar. 7, 1995

[54] CARBONATED SOFT DRINK ATTACHMENT

[75] Inventors: Benjamin Grill, Northridge; Oded E. Sturman, Newbure Park; Walter L. Harrison, Newhall, all of Calif.

[73] Assignee: Kineret Engineering, Northridge, Calif.

[21] Appl. No.: 5,601

[22] Filed: Jan. 19, 1993

[51] Int. Cl.[6] ..... B67D 5/02

[52] U.S. Cl. ..... 222/4; 222/5; 222/396; 222/399; 141/64

[58] Field of Search ..... 222/3, 4, 5, 396, 399; 141/17, 19, 64

[56] References Cited

U.S. PATENT DOCUMENTS

| | | | |
|---|---|---|---|
| 3,203,592 | 8/1965 | Farandatos | 222/5 |
| 3,291,341 | 12/1966 | Simmons | 222/5 X |
| 3,472,292 | 10/1969 | Godfrey | 222/5 X |
| 4,464,956 | 8/1984 | Hashimoto | 222/5 X |
| 4,473,174 | 9/1984 | Heuser | 222/399 X |
| 4,694,850 | 9/1987 | Fumino | 222/5 X |
| 4,867,209 | 9/1989 | Santoiemmo | 141/19 |
| 4,934,543 | 6/1990 | Schmidt | 222/399 X |
| 5,022,565 | 6/1991 | Sturman et al. | 222/5 X |
| 5,139,179 | 8/1992 | Cecil | 222/399 |
| 5,234,015 | 8/1993 | Fumino | 222/5 |

*Primary Examiner*—Andres Kashnikow
*Assistant Examiner*—Kenneth Bomberg
*Attorney, Agent, or Firm*—Blakely, Sokoloff, Taylor & Zafman

[57] ABSTRACT

A attachment that can be attached to the opening of a container to pressurize the same with a gas. The attachment has a housing which holds a removable cartridge that contains either pressurized nitrogen or $CO_2$. Extending from the attachment is a button that is connected to a valve which controls the flow of gas into the container. The button and valve are coupled to a spring which functions as a regulator that controls the gas pressure within the container. When the button is depressed, the valve is opened and the gas is allowed to flow into the container. The spring maintains the valve in the open position until the gas pressure overcomes the spring force and closes the valve. Varying the movement of the button varies the spring force and the gas pressure within the container.

4 Claims, 3 Drawing Sheets

CARBONATED SOFT DRINK ATTACHMENT

BACKGROUND OF THE INVENTION

1. Field of the Invention

The present invention relates to an apparatus that can carbonate liquids within a container.

2. Description of Related Art

Carbonated water and sodas are typically packaged in glass or plastic bottles. When shipped, the bottles are usually sealed with a cap or top that can be subsequently removed. After the seal is broken, the carbon dioxide escapes the bottle. Over time, the soft drink loses most of its carbonation, resulting in a drink that tastes "flat". The release of carbon dioxide from the soft drink therefore limits the amount of time that an opened bottle of soda can be kept and reused.

U.S. Pat. No. 5,022,565 issued to Sturman et al, discloses a attachment that an be attached to a container to recarbonate the contents therein. Although effective the Sturman regulator does not provide manual control of the flow of gas into the container. Therefore the user cannot vary the pressure of the gas within the container. It would be desirable to have a pressurited gas attachment that provides a variable regulator to control the pressure of gas within a soft drink container.

Removing the cork from wine bottle typically requires the insertion of a corkscrew and then the extraction of both the screw and the cork from the bottle. Such a method is somewhat strenuous and time consuming. Additionally, if the corkscrew is not operated correctly the cork may break within the bottle. A broken cork ma y result in unwanted cork particles in the wine. It has also been found that the wine will degrade when exposed to air. Thus even when the cork is reinserted into the bottle, the bottle will still contain air that will reduce the quality of the wine. It would therefore be desirable to have an apparatus that can both remove a cork and purge the wine bottle of air. It would also be desirable if the same apparatus could also carbonate a soft drink within a container.

SUMMARY OF THE INVENTION

The present invention is a attachment that can be attached to the opening of a container to pressurize the same with a gas. The attachment has a housing which holds a removable cartridge that contains either pressurized nitrogen or $CO_2$. Extending from the attachment is a button that is connected to a valve which controls the flow of gas into the container. The button and valve are coupled to a spring that functions as a regulator that controls the gas pressure within the container. When the button is depressed, the valve is opened and the gas s allowed to flow into the container. The spring maint ins the valve in the open position until the gas pressure overcomes the spring force and closes the valve. Varying the movement of the button varies the spring force and the gas pressure within the container. By manipulating the button, the user can thus vary and control the gas pressure of the container.

A needle attachment may be mounted to the attachment. The needle can be inserted through the cork of a wine bottle. The bottle is then pressurized by releasing gas from the cartridge. The pressure within the container pushes the cork out of the bottle. When used with a wine bottle the cartridge typically contains nitrogen.

The nitrogen cartridge can also be used to purge the bottle of air before the cork is reinserted.

To carbonate a soda, the needle can be removed and the nitrogen cartridge can be replaced by a $CO_2$ cartridge. The attachment is then screwed on to a soft drink container. The button is depressed by the uter, so that $CO_2$ is supplied to the soda to carbonate the same. The button provides manual control of the pressurization of the container. Incorporated within the button is a pressure relief valve to prevent overpressurization. The attiachment may be used to both carbonate and recarbonate a soda drink.

Therefore it is an object of this invention to provide a attachment that can remove a cork from a bottle.

It is also an object of this invention to provide an apparatus that can purge a bottle of air.

It is also an object of this invention to provide a attachment that provides a variable regulator.

It is also an object of this invention to provide an apparatus that can remove a cork, carbonate a soft drink and purge a wine bottle of air.

BRIEF DESCRIPTION OF THE DRAWINGS

The objects and advantages of the present invention will become more readily apparent to those skilled in the art after reviewing the following detailed description and accompanying drawings, wherein.

DETAILED DESCRIPTION OF THE INVENTION

Figure 1:
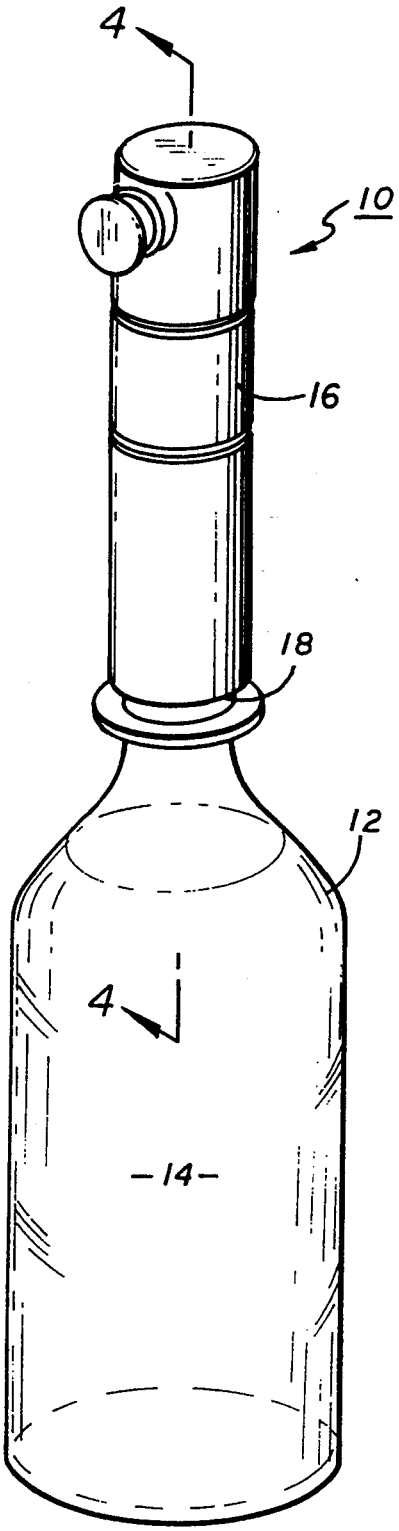
FIG. 1 is a perspective view of a attachment of the present invention attached to a soft drink container.

Referring to the drawings more particularly by reference numbers, FIG. 1 shows a atitachment 10 of the present invention attached to a container 12 that holds a soft drink 14. Although a soft drink iis described, it is to be understood that the container can hold any liquid of which carbonation is desired. The container 12 can be a glass bottle, plastic bottle or any other container suitable to hold a soft drink 14. The attachment 10 has a housing 16 that can be connected to the top 18 of the container 12. When attached to the container 12, the attachment 10 may pressurize the liquid within the container.

Figure 2A:
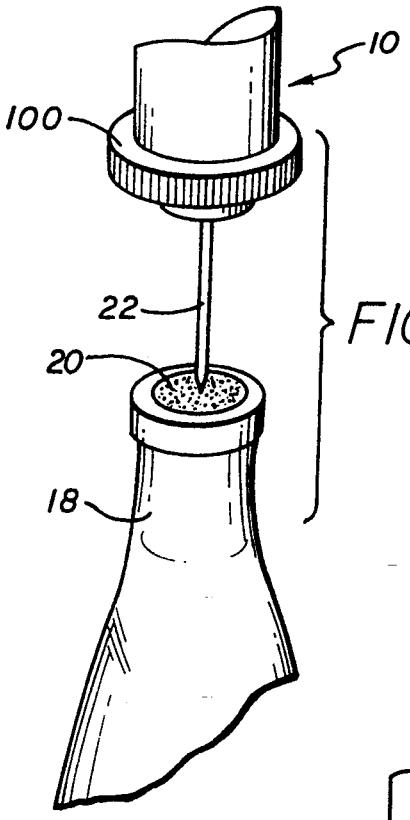
FIG. 2*a* is a perspective view similar to FIG. 1, showing a needle attachment with a needle extending through a cork.
Figure 2B:
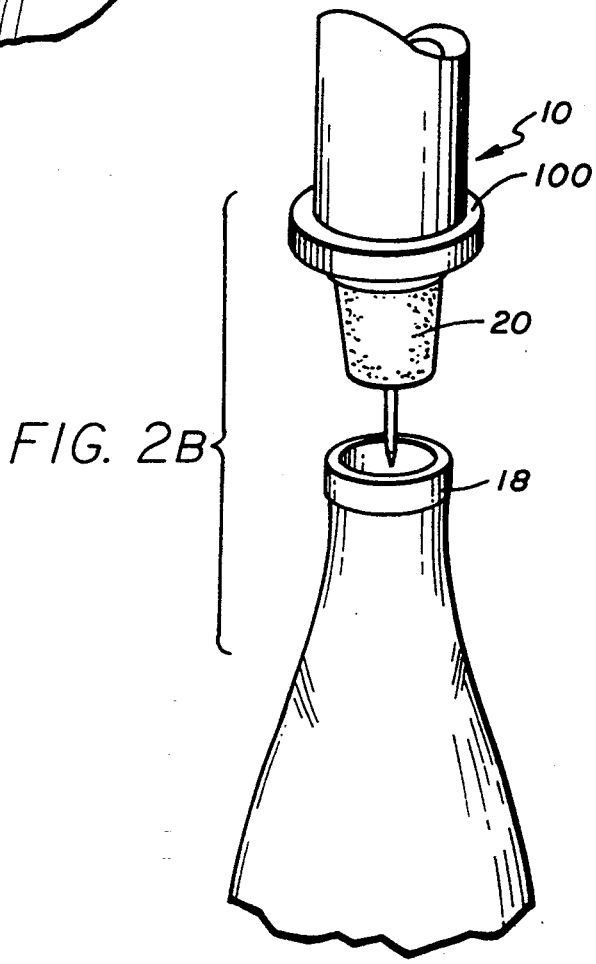
FIG. 2*b* is a perspective view similar to FIG. 2 showing the cork removed from the bottle.

As shown in FIG. 2, the container may be a wine bottle that is sealed by a cork 20. As a means of removing the cork 20, a needle 22 may be mounted onto the attachment 10 and inserted through the cork 20. As shown in FIG. 2*a*, the container 12 can then be pressurized, such that the gas pressure pushes the cork 20 out of the bottle 12. The attachment 10 may also be used to purge the wine of air. To purge, the needle 22 is reinserted into the bottle 12. The cork 20 is placed above the container opening so that air can escape from inside the bottle 12. The container 12 is then purged with gas, preferably nitrogen, which forces the air out of the bottle 12. The cork 20 is then reinserted back into the container 12.

Figure 3:
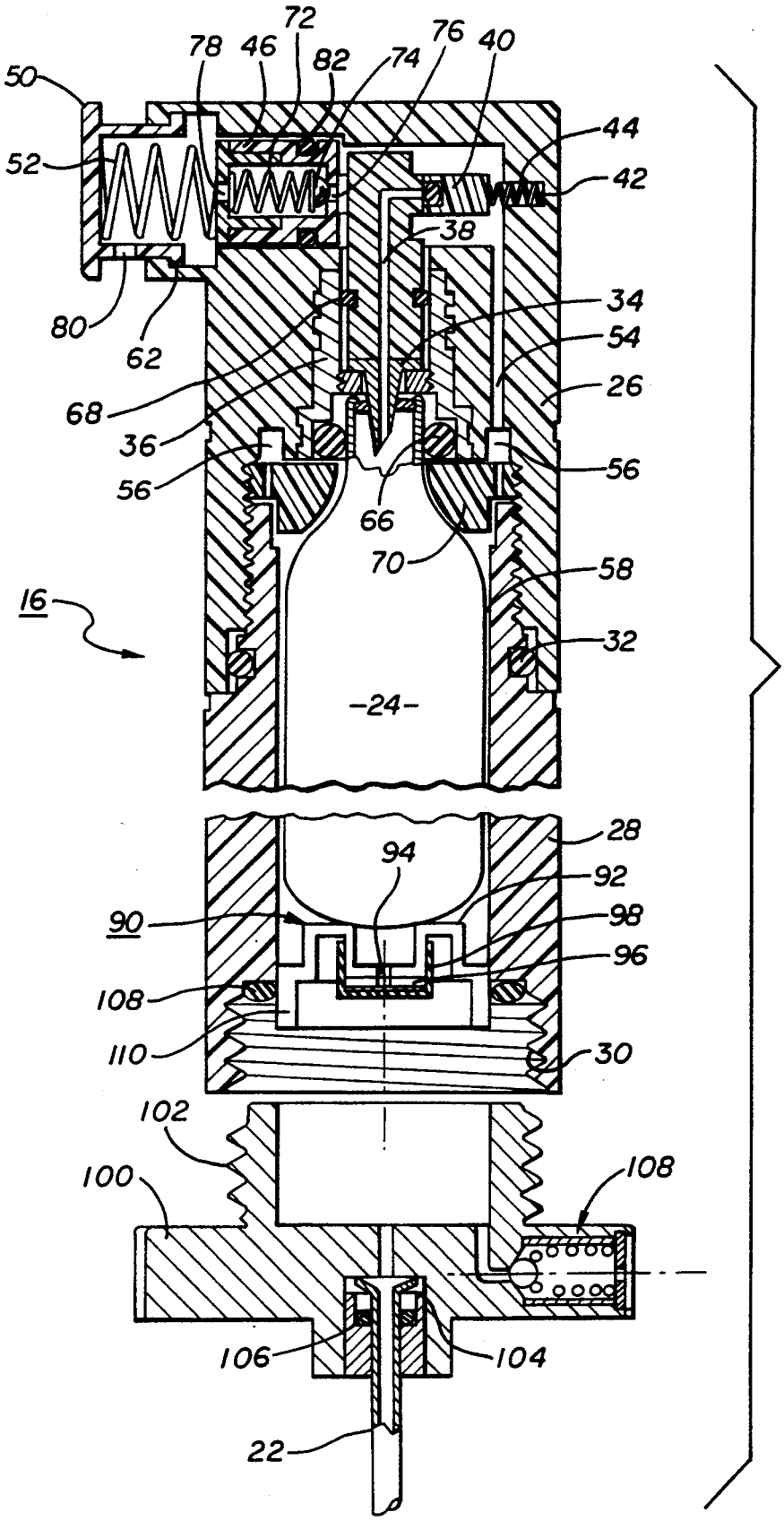
FIG. 3 is a cross-sectional view of the attachment of FIG. 2 with the needle attachment inserted into a wine bottle.

As shown in FIG. 3, the attachment 10 has a cartridge 24 that contains either pressurized nitrogen or $CO_2$. A nitrogen cartridge is typically used when the container 12 contains wine. A $CO_2$ cartridge is used to carbonate a soft drink. The housing 16 may actually be constructed from two pieces that include a valve housing 26 and a cartridge holder 28. The cartridge holder 28 is threadably attached to the valve housing 26 and may be detached to allow the cartridge 24 to be removed and replaced. The cartridge holder 28 has an internal thread 30 that allows the attachment 10 to be attached to a threaded container top. Between the cartridge holder 28 and the valve housing 26 is a first seal 32 that prevents gas from leaking out of the housing 16. The cartridge holder 28 and valve housing 26 are preferably constructed from plastic to reduce the weight and cost of the attachment 10.

The attachment 10 has a cartridge needle 34 that is supported by a needle housing 36, which is threaded into the valve housing 26. The gas cartridge 24 is inserted into the housing 16 until the needle 34 penetrates the opening of the cartridge 24, wherein gas can flow into a first passage 38 of the needle 34. Adjacent to the needle 34 is a valve 40 that is biased into a closed position by a first spring 42. The valve 40 prevents the gas from flowing out of the first passage 38. The first spring 42 is housed within a bore 44 in the valve housing 26.

Figure 4:
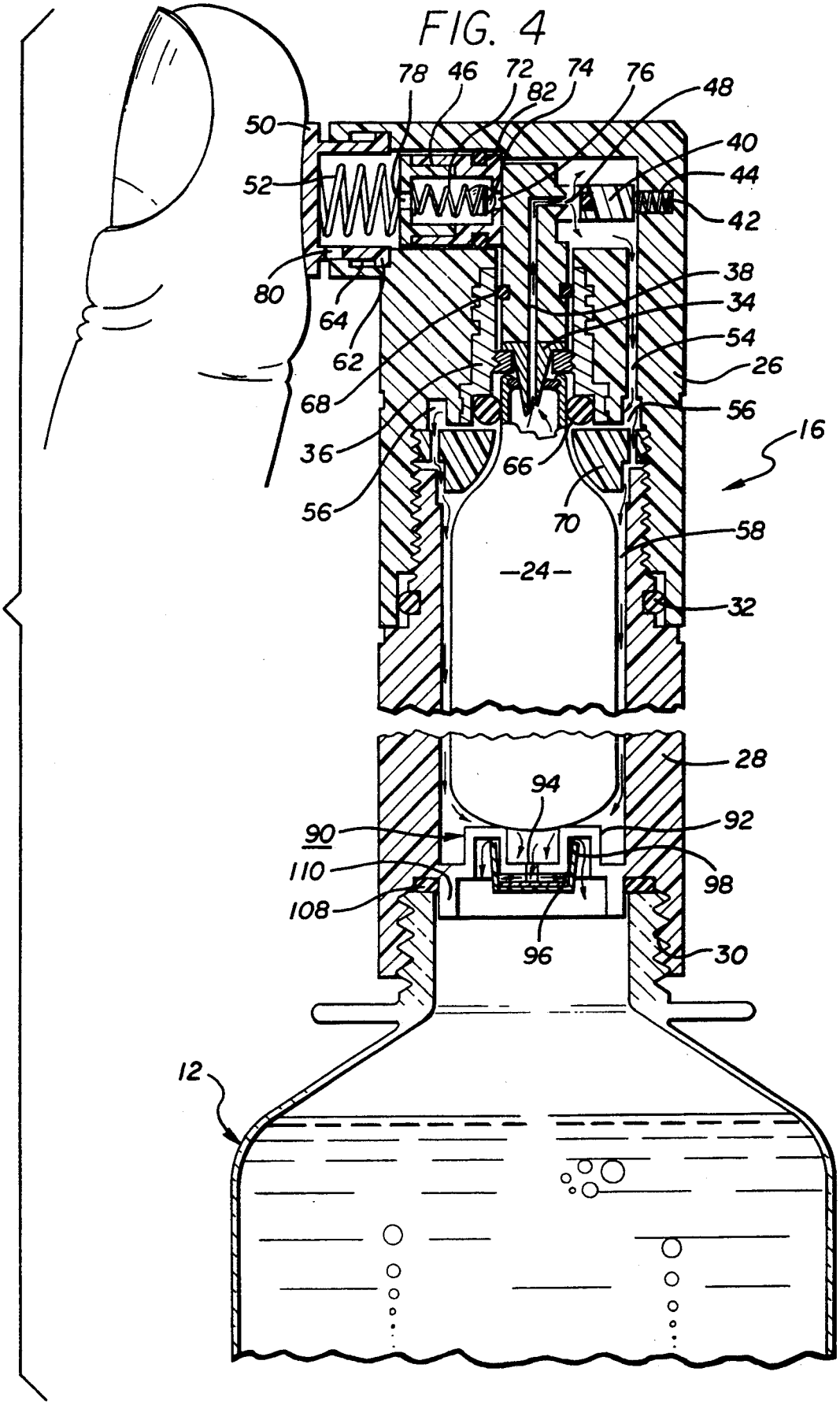
FIG. 4 is a cross-sectional view similar to FIG. 3, showing the carbonation of a soft drink container.

The valve 40 is attached to a piston 46 by an arm 48. The piston 46 is coupled to a button 50 by a second spring 52. As shown in FIG. 4, when the button 50 is depressed, the piston 46 and arm 48 move the valve 40 away from the needle 34 into an open position. When the valve 40 is opened, gas flows from the first passage 38 into a second passage 54 within the valve housing 26. The gas then flows into an annular opening 56 that provides communication to a cavity 58 in the cartridge holder 28. From the cavity 58, the gas flows into the container 12. When the button 50 is released, the first spring 42 pushes the valve 40 back against the cartridge needle 34 to prevent gas from flowing into the container 12. The second spring 52 pushes the button 50 back into the original position.

When gas is released by the valve 40, the pressure of the gas moves the piston 46 toward to the button 50. The piston 46 moves until the valve 40 is moved back into the closed position. The pressure within the container is dependent upon the spring force of the second spring 52. The larger the spring deflection, the higher the pressure within the container 12. By varying the depth of the button 50, the user can therefore control and vary the pressure within the container 12.

The button 50 has an annular shoulder 62 that fits within an annular groove 64 in the valve housing 26. The shoulder 62 and groove 64 arrangement captures the button 50, while allowing the same to move between the depressed and released positions. The apparatus 10 may have a second seal 66 between the cartridge 24 and the needle housing 36 to prevent any gas from leaking out of the attachment 10, when the valve 40 is not open. Likewise, a third seal 68 may be placed between the needle 34 and needle housing 36 to prevent leakage to the second passage 54. The attachment 10 may also have a collar 70 that can provide support to the cartridge 24.

To prevent over pressurization of the container 12, the attachment 10 may have a pressure relief valve that includes a third spring 72 that biases a ball 74 against a first opening 76 in the piston 46. When the gas pressure within the container 12 reaches a predetermined pressure, the ball 74 is pushed away from the first opening 76, wherein the gas is allowed to flow through a second opening 78 in the piston 46, and into the ambient through a third opening 80 in the button 50. The ball 74 will remain unseated until the spring force of the third spring 72 is greater than the force on the ball 74 from the gas pressure. A fourth seal 82 may be installed between the piston 46 and the valve housing 26, to prevent gas from flowing around the piston 46 and into the ambient. The relief valve allows the user to depress the button 50 and open the valve 40 for an indiscriminate amount of time, without over pressurizing the container 12.

In the preferred embodiment, the attachment 10 has a check valve 90 that prevents the soft drink 14 from flowing into the cavity 58. The check valve 90 includes a valve plate 92 that has a valve opening 94. The valve plate 92 has four valve channels 96 that are in fluid communication with the valve opening 94. Extending around the valve plate 92 is a valve 98 which is typicall constructed from an elastic material such as rubber. The valve 98 prevents the soft drink 14 from flowing through the opening 94 and into the cavity 58.

The valve 98 is constructed to deflect when the pressure within the cavity 58 reaches a predetermined level, wherein gas can flow through the valve opening 94 and into the container 12. The valve 90 is preferably constructed to open when the cavity reaches 1–2 psi, creating a quick response between engagement of the button 50, and the time that gas actually flows into the container 12.

The needle 22 can be atitached to a needle attachment plate 100, that has external threads 102 which allow the needle 22 to be screwed into the cartridge holder 28. The needle can be secured by an attachment bushing 104 and a needle O-ring 106. The cartridge holder 28 or needle plate 100 may further have an attachment O-ring 108. The bottom of the cartridge holder 28 may have an annular rib 110. The rib 110 is constructed so that the attachment 10 cannot be screwed all the way down a glass bottle 12, so that the container is not completely sealed from the ambient. The ribs allow the bottle to breath to insure that the glass container does not become pressurized to dangerous levels. The needle attachment 100 may have a pressure relief valve 108. Because most wine bottles are constructed from glass, it is imperative that the bottle does not become overpressurized and explode. The relief valve 108 is typically set well below the maximum pressure level of the bottle so that the glass does not crack or explode.

In operation, the attachment 10 is attached to the top of the container 12. To carbonate a soft drink, the cartridge holder 28 is simply screwed onto the container as shown in FIG. 4. If a cork 20 is to be removed, the needle 22 is screwed into the cartridge holder 28 and inserted through the cork 20, as shown in FIG. 3. With either configuration, the user depresses the button 50, allowing gas to flow into the container 12. The gas flows until the force of the second spring 52 is overcome and the valve 40 moves back into the closed position. The gas pressure of the container 12 can be increases by further depressing the button 50 and increasing the spring force of the second spring 52. The present invention thus allows the user to control and vary the gas pressure within the container 12.

While certain exemplary embodiments have been described in detail and shown in the accompanying drawings, it is to be understood that such embodiments are merely illustrative of and not restrictive on the broad invention, and that this invention not be limited to the specific constructions and arrangements shown and described, since various other modifications may occur to those ordinarily skilled in the art.

What is claimed is:

1. A attachment that can pressurize a container, comprising:

a housing with an opening, said housing being adapted to be coupled to the container;

a cartridge within said housing, said cartridge containing a pressurized gas;

a valve operatively connected to said cartridge, said valve being adapted to move between a closed position and an open position, such that said valve allows said gas to flow through said housing opening and into the container when in an open position;

a first spring connected to said valve to bias said valve into said closed position;

a button that can move relative to said housing and is operatively connected to said valve to move said valve from said closed position to said open position, thereby providing a gas pressure within the container, a second spring connected to said button and said valve, said second spring provides a spring force on said valve and biases said valve into said open position when said button is moved a predetermined distance, said valve moves from said open position to said closed position in response to said gas pressure within the container reaching a first predetermined level, wherein said first predetermined gas pressure level can be varied by moving said button; and, a pressure relief valve operatively connected to said valve and said button, said pressure relief valve allows said gas to flow into the ambient through an opening in said button when said gas pressure within the container reaches a second predetermined level.

2. The attachment as recited in claim 1, further comprising a needle constructed to be attached to said housing such that said gas passes through said needle into the container.

3. The attachment as recited in claim 2, wherein said cartridge contains carbon dioxide.

4. The attachment as recited in claim 2, wherein said cartridge contains nitrogen.

* * * * *

UNITED STATES PATENT AND TRADEMARK OFFICE

CERTIFICATE OF CORRECTION

PATENT NO. : 5,395,012

DATED : March 7, 1995

INVENTOR(S) : Grill et al.

It is certified that error appears in the above-identified patent and that said Letters Patent is hereby corrected as shown below:

In column 1 at line 34 change "ma y" to --may--.

In column 1 at line 56 change "gas s" to --gas--.

In column 1 at line 56 change "maint ins" to --maintains--.

In column 2 at line 6 change "uter," to --user,--

In column 2 at line 11 change "attiachment" to --attachment--.

In column 2 at line 44 change "atitachment" to --attachment--.

In column 2 at line 46 change "iis" to --is--.

In column 4 at line 21 change "typicall" to --typically--.

Signed and Sealed this

Thirtieth Day of May, 1995

*Attest:*

Bruce Lehman

BRUCE LEHMAN

*Attesting Officer*

*Commissioner of Patents and Trademarks*